US009892472B2

(12) United States Patent
Ji et al.

(10) Patent No.: US 9,892,472 B2
(45) Date of Patent: Feb. 13, 2018

(54) COST OPTIMIZATION FOR BUILDINGS WITH HYBRID VENTILATION SYSTEMS

(71) Applicants: Kun Ji, Plainsboro, NJ (US); Yan Lu, West Windsor, NJ (US)

(72) Inventors: Kun Ji, Plainsboro, NJ (US); Yan Lu, West Windsor, NJ (US)

(73) Assignee: Siemens Corporation, Iselin, NJ (US)

( * ) Notice: Subject to any disclaimer, the term of this patent is extended or adjusted under 35 U.S.C. 154(b) by 537 days.

(21) Appl. No.: 13/763,826

(22) Filed: Feb. 11, 2013

(65) Prior Publication Data

US 2013/0226359 A1 Aug. 29, 2013

Related U.S. Application Data

(60) Provisional application No. 61/603,517, filed on Feb. 27, 2012.

(51) Int. Cl.
*F24F 11/00* (2006.01)
*G06Q 50/06* (2012.01)

(52) U.S. Cl.
CPC ..... *G06Q 50/06* (2013.01); *F24F 11/006* (2013.01); *F24F 2011/0047* (2013.01); *F24F 2011/0075* (2013.01)

(58) Field of Classification Search
CPC ..... G06Q 50/06; F24F 11/006; F24F 2011/0075; F24F 2011/0047
USPC ..... 700/291, 286, 276
See application file for complete search history.

(56) References Cited

U.S. PATENT DOCUMENTS 5,058,388 A * 10/1991 Shaw ..... F24F 3/044 62/176.6
5,170,935 A * 12/1992 Federspiel ..... F24F 11/0009 236/44 C
5,615,134 A * 3/1997 Newsham ..... G06Q 30/02 434/322
5,700,993 A * 12/1997 Counsell et al. ..... 219/483
5,751,916 A * 5/1998 Kon ..... F24F 11/0009 700/299
5,762,265 A * 6/1998 Kitamura ..... F24F 11/006 165/205
5,924,486 A * 7/1999 Ehlers et al. ..... 165/238
6,785,592 B1 * 8/2004 Smith et al. ..... 700/291
7,953,518 B2 * 5/2011 Kansal et al. ..... 700/295
(Continued)

FOREIGN PATENT DOCUMENTS

WO 2011/072332 A1 6/2011

OTHER PUBLICATIONS

Zhang, H., "Human Thermal Sensation and Comfort in Transient and Non-Uniform Thermal Environments", Sep. 1, 2003, University of California, Berkeley.*

(Continued)

*Primary Examiner* — Mohammad Ali
*Assistant Examiner* — Kelvin Booker

(57) ABSTRACT

A method including: computing a total cost for a first zone in a building, wherein the total cost is equal to an actual energy cost of the first zone plus a thermal discomfort cost of the first zone; and heuristically optimizing the total cost to identify temperature setpoints for a mechanical heating/cooling system and a start time and an end time of the mechanical heating/cooling system, based on external weather data and occupancy data of the first zone.

14 Claims, 20 Drawing Sheets

(56) References Cited

U.S. PATENT DOCUMENTS

| | | | | |
|---|---|---|---|---|
| 8,428,785 | B2 * | 4/2013 | Boucher et al. | 700/295 |
| 8,538,586 | B2 * | 9/2013 | Amundson et al. | 700/276 |
| 8,755,943 | B2 * | 6/2014 | Wenzel | 700/276 |
| 2002/0152298 | A1 * | 10/2002 | Kikta et al. | 709/223 |
| 2003/0171851 | A1 * | 9/2003 | Brickfield et al. | 700/286 |
| 2004/0117330 | A1 * | 6/2004 | Ehlers | F24F 11/0012 705/412 |
| 2004/0133406 | A1 * | 7/2004 | Ozeki | G01W 1/17 703/2 |
| 2004/0182941 | A1 * | 9/2004 | Alles | F24F 3/0442 236/49.3 |
| 2004/0267408 | A1 | 12/2004 | Kramer | |
| 2005/0096797 | A1 * | 5/2005 | Matsubara | H02J 3/00 700/291 |
| 2007/0043478 | A1 * | 2/2007 | Ehlers | F24F 11/0012 700/276 |
| 2008/0277486 | A1 * | 11/2008 | Seem | F24F 11/0009 236/49.3 |
| 2009/0005912 | A1 * | 1/2009 | Srivastava | G05B 13/044 700/276 |
| 2010/0262313 | A1 * | 10/2010 | Chambers | G06Q 10/04 700/295 |
| 2010/0286937 | A1 * | 11/2010 | Hedley et al. | 702/60 |
| 2010/0324962 | A1 * | 12/2010 | Nesler et al. | 705/8 |
| 2010/0332373 | A1 * | 12/2010 | Crabtree | G06Q 50/06 705/37 |
| 2011/0047418 | A1 * | 2/2011 | Drees et al. | 714/57 |
| 2011/0061015 | A1 * | 3/2011 | Drees et al. | 715/771 |
| 2011/0153088 | A1 | 6/2011 | Gwerder et al. | |
| 2011/0218691 | A1 * | 9/2011 | O'Callaghan | G06Q 10/06 700/296 |
| 2011/0231320 | A1 * | 9/2011 | Irving | 705/80 |
| 2011/0238223 | A1 * | 9/2011 | Narayanamurthy | F24F 5/0046 700/277 |
| 2011/0290893 | A1 * | 12/2011 | Steinberg | F24F 11/0034 236/49.3 |
| 2012/0031984 | A1 | 2/2012 | Feldmeier et al. | |
| 2012/0179298 | A1 * | 7/2012 | Ha | G05B 19/042 700/276 |
| 2012/0259469 | A1 * | 10/2012 | Ward | G05D 23/1917 700/276 |
| 2012/0296482 | A1 * | 11/2012 | Steven et al. | 700/291 |
| 2013/0060391 | A1 * | 3/2013 | Deshpande | F24F 11/0009 700/291 |
| 2013/0085609 | A1 * | 4/2013 | Barker | G05B 15/02 700/276 |
| 2013/0085614 | A1 * | 4/2013 | Wenzel et al. | 700/277 |
| 2013/0099011 | A1 * | 4/2013 | Matsuoka | G05D 23/1904 236/1 C |
| 2013/0158713 | A1 * | 6/2013 | Geissler | G05D 23/1932 700/275 |
| 2013/0204443 | A1 * | 8/2013 | Steven et al. | 700/286 |
| 2013/0226320 | A1 * | 8/2013 | Berg-Sonne et al. | 700/90 |
| 2013/0231792 | A1 * | 9/2013 | Ji et al. | 700/291 |
| 2014/0039709 | A1 * | 2/2014 | Steven et al. | 700/291 |
| 2014/0094980 | A1 * | 4/2014 | Saito | G05B 13/026 700/291 |
| 2014/0249680 | A1 * | 9/2014 | Wenzel | H02J 3/14 700/276 |
| 2014/0304025 | A1 * | 10/2014 | Steven et al. | 705/7.24 |
| 2015/0028114 | A1 * | 1/2015 | Rosen | F24F 11/0034 236/51 |
| 2015/0094968 | A1 * | 4/2015 | Jia et al. | 702/60 |
| 2017/0032476 | A1 * | 2/2017 | Keil | G06Q 50/06 |

OTHER PUBLICATIONS

Zhang, Y. and Zhao, R., "Relationship between Thermal Sensation and Comfort in Non-Uniform and Dynamic Environments", 2009, Building and Environment, 44, 1386-1391.*

Zhang, Y. and Zhao, R., "Overall Thermal Sensation, Acceptability and Comfort", 2008, Building and Environment, 43, 44-50.*

Yao, R., Li, B. and Liu, J., "A Theoretical Adaptive Model of Thermal Comfort—Adaptive Predicted Mean Vote (aPMV)", 2009, Building and Environment, 44, 2089-2096.*

Hamdi, M., Lachiver, G. and Michaud, F., "A New Predictive Thermal Sensation Index of Human Response", provided to the public on May 1997, published Energy and Buildings, 29, 1999, 167-178.*

Fountain, M. and Huizenga, C., "A Thermal Sensation Prediction Software Tool for Use by the Profession", Jan. 1, 1997, University of California Berkeley, Center for the Built Environment.*

Atmaca, I.; Kaynakli, O. and Yigit, A., "Effects of Radiant Temperature on Thermal Comfort", Oct. 13, 2004, Building and Environment, vol. 42, pp. 3210-3220.*

Butera, F.M., "Chapter 3—Principles of Thermal Comfort", 1998, Renewable and Sustainable Energy Reviews, vol. 2, pp. 39-66.* de Dear, R.J. and Brager, G.S., "Developing an Adaptive Model of Thermal Comfort and Preference", 1998, ASHRAE Transactions, vol. 104, pp. 145.*

Dounis, A.I. and Caraiscos, C., "Advanced Control Systems Engineering for Energy and Comfort Management in a Building Environment—A Review", 2009, Renewable and Sustainable Energy Reviews, vol. 13, pp. 1246-1261.*

Freire, R.Z.; Oliveira, G.H.C. and Mendes, N., "Predictive Controllers for Thermal Comfort Optimization and Energy Savings", 2008, Energy and Buildings, vol. 40, pp. 1353-1365.*

Ferreira, P.M.; Ruano, A.E.; Silva, S. and Conceicao, E.Z.E., "Neural Networks Based Predictive Control for Thermal Comfort and Energy Savings in Public Buildings", Feb. 17, 2012, Energy and Buildings, vol. 55, pp. 238-251.*

Holz, R.; Hourigan, A.; Sloop, R.; Monkman, P. and Krarti, M., "Effects of Standard Energy Conserving Measures on Thermal Comfort", Mar. 1995, Building and Environment, vol. 32, No. 1, pp. 31-43.*

Hwang, R.-L.; Cheng, M.-J.; Lin, T.-P. and Ho, M.-C., "Thermal Percptions, General Adaptation Methods and Occupant's Idea About the Trade-off Between Thermal Comfort and Energy Saving in Hot-Humid Regions", 2009, Building and Environment, vol. 44, pp. 1128-1134.*

Klein, L.; Kwak, J.-Y.; Kavulya, G.; Jazizadeh, F.; Becerik-Gerber, B.; Varakantham, P. and Tambe, M., "Coordinating Occupant Behavior for Building Energy and Comfort Management Using Multi-Agent Systems", Nov. 28, 2011, Automation in Construction, vol. 22, pp. 525-536.*

Nguyen, T.A. and Aiello, M., "Energy Intelligent Buildings Based on User Activity: A Survey", May 11, 2012, Energy and Buildings, vol. 56, pp. 244-257.*

Humphreys, M.A. and Nicol, J.F., "Understanding the Adaptive Approach to Thermal Comfort", 1998, ASHRAE Transactions, vol. 104, pp. 991.*

Virote, J. and Neves-Silva, R., "Stochastic Models for Building Energy Prediction Based on Occupant Behavior Assessment", Aug. 16, 2011, Energy and Buildings, vol. 53, pp. 183-193.*

Zeiler, W.; van Houten, R.; Boxem, G.; Vissers, D. and Maaijen, R., "Indoor Air Quality and Thermal Comfort Strategies:The Human-in-the-loop Approach", Oct. 18-20, 2011, Proc. of the 11th Intl. Conf. Enhanced Building Operations, New York City.*

Feustel, E.H., Ed. (1990). COMIS Fundamentals. Lawrence Berkeley Laboratory, Berkeley, CA., pp. I-115.

Schiller Brager, Gail and de Dear, Richard, 2000. A Standard for Natural Vventilation. ASHRAE Journal. 42: 21-28.

Jreijiry, D., Husaunndee, A., and Inard, C., 2005. Numerical Evaluation of Hybrid Ventilation Control Strategies, Ninth International IBPSA Conference, Montreal, Canada Aug. 15-18, 2005, pp. 483-490.

Lixing, G., 2007. Airflow Network Modeling in EnergyPlus. Proceedings: Building Simulation 2007, pp. 964-971.

Mankibi, M.E., et al. 2006. Prediction of hybrid ventilation performance using two simulation tools. Solar Energy, 80 (2006) 908-926.

Lan, L., Wargocki, P., and Lian, Z., 2011. Quantitative measurement of productivity loss due to thermal discomfort. Energy and Buildings. 43 (2011) 1057-1062.

(56) References Cited

OTHER PUBLICATIONS

Spencer Dutton, et al., 2008. Validation and parametric analysis of energyplus: airflow network model using contam. Third National Conference of IBPSA-USA, Berkeley, CA., Jul. 30-Aug. 1, 2008. pp. 124-131.
Emmerich, S.J. and Crum, J., Simulated Performance of Natural and Hybrid Ventilation Systems in an Office Building. Feb. 2005.
Zhai, Z., et al., 2011. Assessment of natural and hybrid ventilation models in whole-building energy simulations. Energy and Buildings. 43 (2011) 2251-2261.
International Search Report dated Sep. 9, 2013.

* cited by examiner

Electricity

Natural Gas

| Delivery | BGSS | |
|---|---|---|
| 0.4964 | 0.746 | $/therm |

| Location | Day | Start Time | Duration (h) | Energy Savings |
|---|---|---|---|---|
| Phoenix | 24-Feb | 11 | 7 | 10.2% |
| Miami | 22-Feb | 11 | 6 | 19.4% |
| Fairbanks | 21-Jul | 13 | 3 | 45.4% |
| Boulder | 20-Sep | 7 | 0 | 100.0% |
| Atlanta | 11-Sep | 9 | 7 | 24.4% |
| Chicago | 27-May | 7 | 0 | 100.0% |
| Baltimore | 17-May | 12 | 5 | 29.9% |
| Duluth | 10-May | 7 | 0 | 100.0% |
| Minneapolis | 14-Aug | 9 | 7 | 35.8% |
| Helena | 4-Aug | 14 | 4 | 34.3% |
| Albuquerque | 21-Jun | 7 | 12 | 6.7% |
| Las Vegas | 9-Jun | 7 | 10 | 22.4% |
| Houston | 10-Feb | 12 | 2 | 47.7% |
| Seattle | 29-Aug | 10 | 7 | 22.2% |
| Los Angeles | 29-Oct | 13 | 4 | 49.1% |
| San Francisco | 29-Jun | 10 | 6 | 25.0% |

FIG. 5

COST OPTIMIZATION FOR BUILDINGS WITH HYBRID VENTILATION SYSTEMS

CROSS-REFERENCE TO RELATED APPLICATION

This application claims priority under 35 U.S.C. § 119 to U.S. provisional application No. 61/603,517 filed Feb. 27, 2012, the disclosure of which is incorporated by reference herein in its entirety.

GOVERNMENT INTERESTS

This invention is partially supported by the U.S. Department of Energy under Grant DE-EE-0003843. The U.S. Government has certain rights in this invention

BACKGROUND OF THE INVENTION

1. Technical Field

The present invention relates to optimizing energy cost of a building with natural and mechanical ventilation systems.

2. Discussion of the Related Art

A hybrid building ventilation system is a system providing a comfortable indoor environment using both natural ventilation and mechanical systems, but with different modes of the systems at different times of the day. Many new energy efficient buildings are equipped with operable windows to enable natural ventilation to minimize energy consumption while maintaining acceptable indoor air quality and thermal comfort during working hours. Naturally ventilated buildings can provide better thermal comfort than air conditioned buildings. According to the American Society of Heating, Refrigerating and Air-Conditioning Engineers (ASHRAE) standard 55, people tolerate higher room temperatures in buildings with natural ventilation. However, the start time and the duration of natural ventilation affect mechanical ventilation energy consumption and indoor thermal comfort. As such, there is a tradeoff between energy saving and thermal comfort.

SUMMARY OF THE INVENTION

In an exemplary embodiment of the present invention, we formulate the tradeoff between energy saving and thermal comfort as an optimization problem and use building simulations to optimize total cost by adjusting the natural ventilation period during the day. The total cost considers both actual energy cost and thermal discomfort cost caused by compromising a certain scale of comfort to achieve best energy saving performance. A modified benchmark EnergyPlus model with hybrid ventilation is used to verify the feasibility and effectiveness of our total cost optimization methodology. After the optimization, the best heating, ventilation, and air conditioning (HVAC) system start time and operation duration are identified.

In an exemplary embodiment of the present invention, there is provided a method including: computing a total cost for a first zone in a building, wherein the total cost is equal to an actual energy cost of the first zone plus a thermal discomfort cost of the first zone; and heuristically optimizing the total cost to identify temperature setpoints for a mechanical heating/cooling system and a start time and an end time of the mechanical heating/cooling system, based on external weather data and occupancy data of the first zone.

The first zone includes at least one room.

The actual energy cost of the first zone is equal to electricity cost of the first zone for a predetermined time plus gas/oil cost of the first zone for the predetermined time.

The thermal discomfort cost of the first zone is a cost value lost due to discomfort of at least one person in the first zone.

The temperature set points include a temperature of the first zone for a minimum cooling cost or a temperature of the first zone for a minimum heating cost.

Windows in the first zone are closed at the start time of the mechanical heating/cooling system and the windows in first zone are opened at the end time of the mechanical heating/cooling system.

The method further includes, prior to the step of heuristically optimizing, simulating energy consumption of the first zone for a predetermined time by using temperature set points, a start time and an end time of the mechanical heating/cooling system associated with the computed total cost.

The heuristic optimization includes repeating steps of computing a total cost and simulating energy consumption using different temperature setpoints, start times and end times of the mechanical heating/cooling system.

In an exemplary embodiment of the present invention, there is provided a system including: a memory device for storing a program; a processor in communication with the memory device, the processor operative with the program to: compute a total cost for a first zone in a building, wherein the total cost is equal to an actual energy cost of the first zone plus a thermal discomfort cost of the first zone; and heuristically optimize the total cost to identify temperature setpoints for a mechanical heating/cooling system and a start time and an end time of the mechanical heating/cooling system, based on external weather data and occupancy data of the first zone.

The first zone includes at least one room.

The actual energy cost of the first zone is equal to electricity cost of the first zone for a predetermined time plus gas/oil cost of the first zone for the predetermined time.

The temperature set points include a temperature of the first zone for a minimum cooling cost or a temperature of the first zone for a minimum heating cost.

Windows in the first zone are closed at the start time of the mechanical heating/cooling system and the windows in first zone are opened at the end time of the mechanical heating/cooling system.

The processor is further operative with the program to simulate energy consumption of the first zone for a predetermined time by using temperature set points, a start time and an end time of the mechanical heating/cooling system associated with the computed cost, wherein the simulation occurs prior to the heuristic optimization.

In an exemplary embodiment of the present invention, there is provided a computer program product including: a non-transitory computer readable storage medium having computer readable program code embodied therewith, the computer readable program code including: computer readable program code configured to perform the steps of: computing a total cost for a first zone in a building, wherein the total cost is equal to an actual energy cost of the first zone plus a thermal discomfort cost of the first zone; and heuristically optimizing the total cost to identify temperature setpoints for a mechanical heating/cooling system and a start time and an end time of the mechanical heating/cooling system, based on external weather data and occupancy data of the first zone.

The first zone includes at least one room.

The actual energy cost of the first zone is equal to electricity cost of the first zone for a predetermined time plus gas/oil cost of the first zone for the predetermined time.

The temperature set points include a temperature of the first zone for a minimum cooling cost or a temperature of the first zone for a minimum heating cost.

Windows in the first zone are closed at the start time of the mechanical heating/cooling system and the windows in first zone are opened at the end time of the mechanical heating/cooling system.

The computer readable program code is further configured to perform the step of simulating energy consumption of the first zone for a predetermined time by using temperature set points, a start time and an end time of the mechanical heating/cooling system associated with the computed cost, prior to the step of heuristically optimizing.

BRIEF DESCRIPTION OF THE DRAWINGS

FIG. 5 is a table illustrating optimized HVAC operation time and duration;

DETAILED DESCRIPTION OF EXEMPLARY EMBODIMENTS

Figure 1:
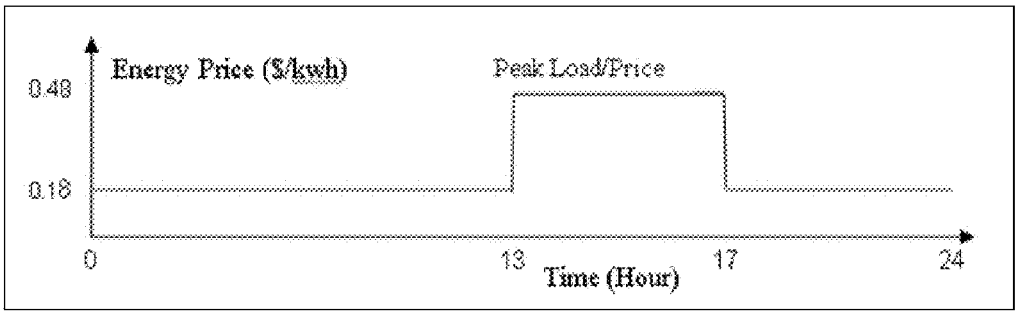
FIG. 1 is a pair of graphs illustrating example electricity and gas costs.

In accordance with an exemplary embodiment of the present invention, a total cost optimization methodology in building control and operations considering both energy and discomfort cost is disclosed herein. In accordance with exemplary embodiment of the present invention, a simulation model used to estimate the total cost is a modified benchmark building model which can simulate a building with hybrid ventilation in a quick and easy way. A control co-simulation platform with Matlab and EnergyPlus is established to verify this optimization methodology and give out the optimized natural ventilation time in different climate zones.

In detail, the hybrid ventilation model, according to an exemplary embodiment of the present invention, was built on the benchmark building model, which the American Society of Heating, Refrigerating and Air-Conditioning Engineers (ASHRAE) designed as a standard for 16 different climate areas in the United States. The best performance time is found by a heuristic optimization method which is operated and controlled through Matlab. The modified model describes the potential of exterior zones to be naturally ventilated. Quick and easy estimation of the energy saving achieved by implementing hybrid ventilation on existing buildings is provided. This method eliminates the excessive effort needed in creating a complicated building model to make such estimates. In addition to the easy application of this modified EnergyPlus model, thermal comfort is also considered by quantifying it into thermal cost. The concept of discomfort cost is introduced and used for the optimization of total cost to find the best hybrid ventilation operation duration. A heuristic optimization method is implemented to solve this optimization problem. By trading off between heating, ventilation, and air conditioning (HVAC) operation time and natural ventilation time, an optimized operation time for both HVAC and natural ventilation time is presented. The inventive methodology could be applied to other types of buildings to get a general estimation of all buildings in the same climate area.

A discussion of the airflow network model in EnergyPlus is now provided.

The airflow network model in EnergyPlus provides the ability to simulate multizone wind-driven airflows. The current airflow network model in EnergyPlus consists of three sequential steps: (1) pressure and airflow calculations; (2) node temperature and humidity calculations; and (3) sensible and latent load calculations.

The airflow network model in EnergyPlus has four mode controls. (1) Multizone air flow calculations during all simulation time steps, including the impacts of the air distribution system when the HVAC system fan is operating. (2) Multizone airflow calculations during all simulation time steps (except no air distribution system modeling). (3) Multizone airflow calculations, including the impacts of the air distribution system, but only when the HVAC system fan is operating. (4) No multizone or air distribution system air flow calculations.

The one adopted in the natural ventilation simulation in this disclosure is "multizone without distribution," e.g., 2.

A discussion of the concept of total cost is now provided.

The total cost considers both discomfort cost and energy cost as shown in the equations 1 and 2.

$$\text{Total cost}=\text{Discomfort cost}+\text{Energy cost} \quad (1)$$

$$\text{Energy cost}=\text{Electricity cost}+\text{Gas cost} \quad (2)$$

FIG. 1 is a pair of graphs illustrating example electricity and gas costs. Electricity costs may be those associated with energy consumed by lighting, equipment, cooling, fans, pumps, etc. Gas costs may be those associated with gas consumed due to general heating, water heating, etc.

The relation between thermal sensation vote (tsv) and relative performance (RP) compared to maximum performance is shown in equation 3. The establishment of this relation helps to quantify the thermal discomfort cost as shown in equation 4.

$$RP=-0.035tsv^3-0.5294tsv^4-0.215tsv+99.865 \quad (3)$$

$$\text{Discomfort cost}=(1-RP)*pr_{max}*\text{people} \quad (4)$$

In the above equations 3 and 4, RP is relative performance compared to maximum performance $pr_{max}$, $T_{op}$ is an operative temperature of a single zone or a plurality of zones, $pr_{max}$ is a maximum performance rate which indicates the maximum value that could be generated by a person if that person is at their full thermal comfortness, the rate is in dollars per hour, tsv is the thermal sensation vote (−3 to +3 on the ASHRAE seven-point thermal sensation scale), and people may be the number of people in a single zone or a plurality of zones.

For example, $pr_{max}$ is a conceptual definition which defines the maximum value that could be generated by one person if that person is at their full thermal comfort. If the person is not completely comfortable, then the person's performance is impacted. The person has relative performance (RP). If RP=1, this means the person is completely comfortable. In this case, there is no discomfort cost. If RP=0, this means the person is completely uncomfortable. In this case, the discomfort cost may be $30/hr. In other words, $30/hr are lost due to the person's level of discomfort.

A discussion of the comfort model is now provided.

For naturally ventilated buildings, the comfort model may be that shown in equation 5.

$$tsv=0.27*T_{op}-0.65 \quad (5)$$

In equation 5, $T_{op}$ may be an operative temperature of a single zone or a plurality of zones.

A discussion of the modified natural ventilation model according to an exemplary embodiment of the present invention applied to an EnergyPlus benchmark building will now be provided.

Figure 2:
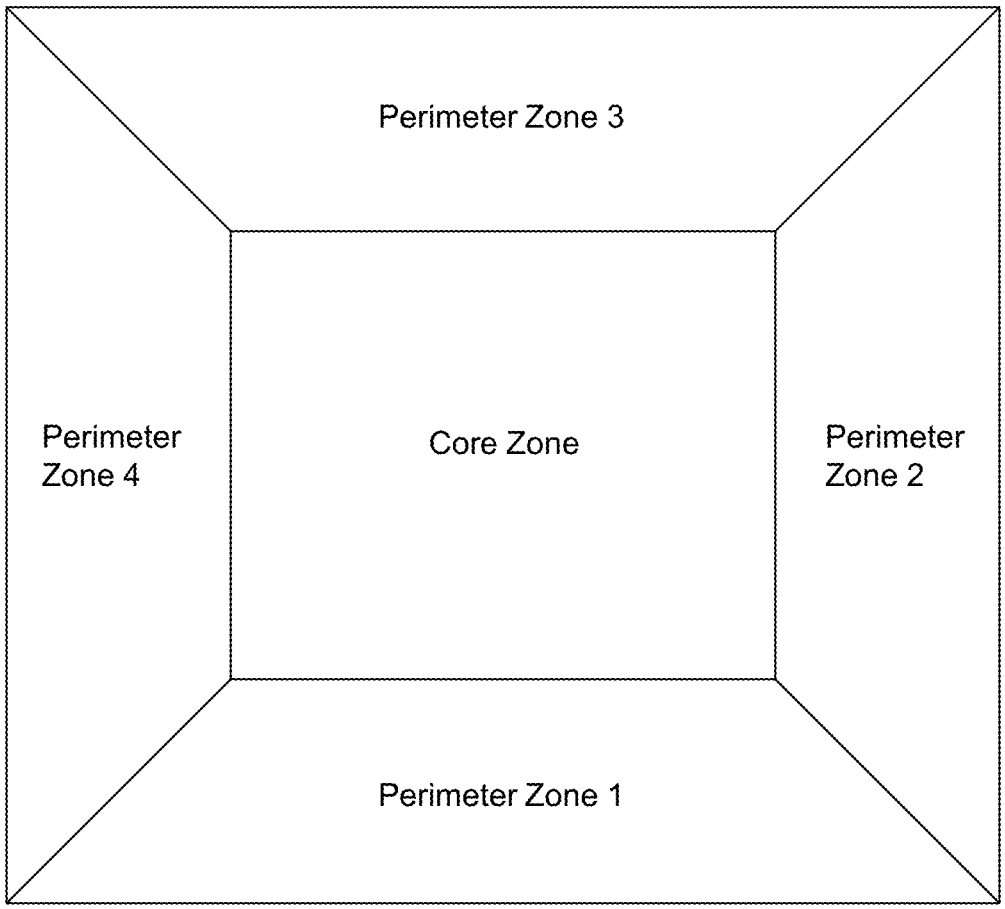
FIG. 2 illustrates a benchmark building model zone layout.

Simulations are carried out based on the modified EnergyPlus benchmark building model. This model was designated alternatively to simulate both the natural ventilation and the HVAC system energy operation. After introducing the thermal discomfort cost into the simulation, the total cost is optimized by searching for the best HVAC operation start time and duration. The benchmark building selected for this example is the small office building type. FIG. 2 shows an example of this building which has a core zone and perimeter zones 1-4. The reason to select this building model is that the energy consumption for each zone could be separated easily. There are five zones in the small office type benchmark building of FIG. 2. The four perimeter zones 1-4 are considered for natural ventilation and the energy consumption of the four zones is considered in the total cost optimization.

It is understood that a zone may include one or more rooms. The HVAC system may include a cooling system, e.g., five DX coil units serving each conditioned zone, and a heating system (e.g., gas heating coil). A plant system may include a service water system such as a water heater.

The operation schedule is controlled from Matlab which enables that when an HVAC is on, the natural ventilation is off and when the natural ventilation is off, the HVAC is on. This operation logic is shown in FIG. 3.

Figure 3:
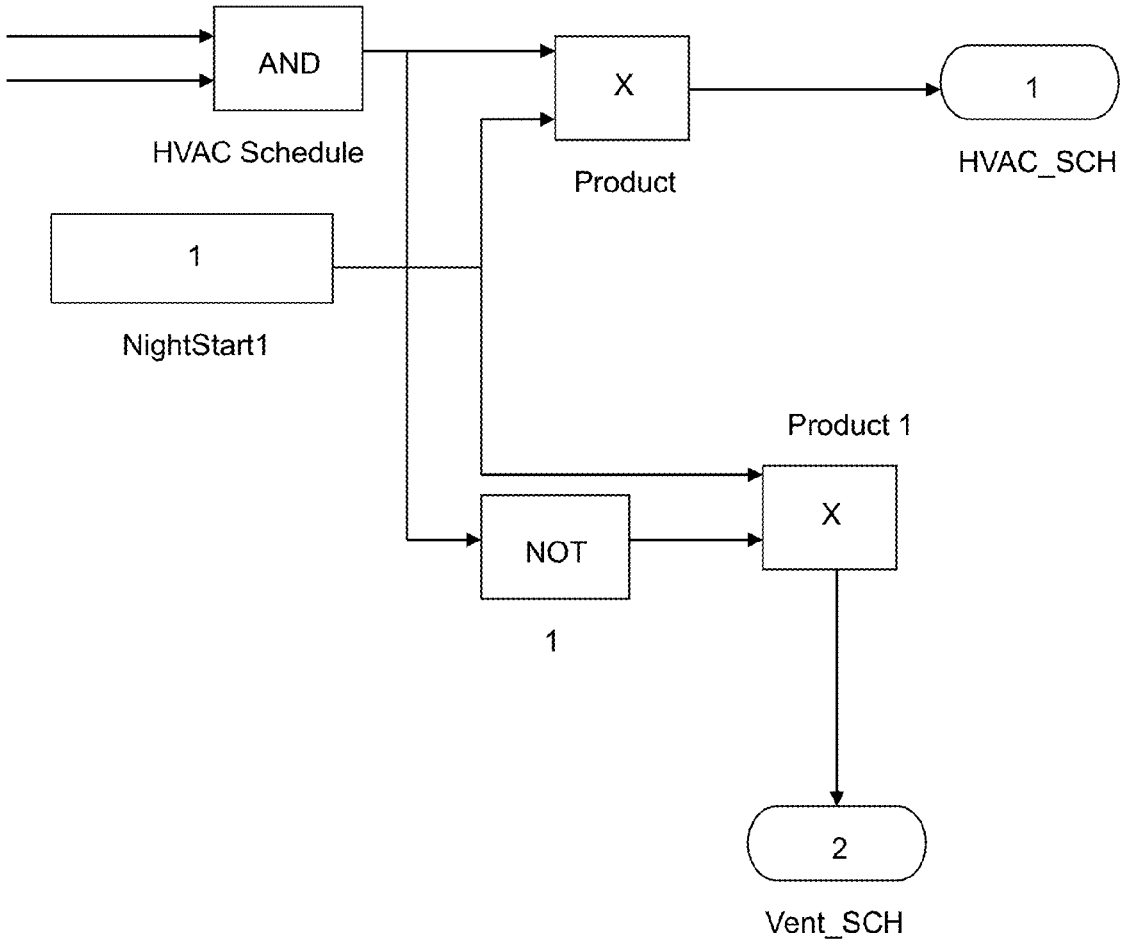
FIG. 3 illustrates a schedule for heating, ventilation, and air conditioning (HVAC) operation and natural ventilation, according to an exemplary embodiment of the present invention.

More specifically, in FIG. 3 Temperature Set-point corresponds to a temperature set point, HVAC_SCH corresponds to a schedule for when to turn on/off the HVAC, Nature Vent_SCH corresponds to a schedule for when to open/close windows, and logic AND, NOT and Mux, which are based on external info, enables switching between the schedules HVAC_SCH and Vent_SCH such that the HVAC is on when the windows are closed and the HVAC is off when the windows are open. Pre-defined HVAC Schedule corresponds to a pre-defined schedule used for Heuristic search. FIG. 3 shows part of the simulation layout to find out the optimized temperature set-point and HVAC schedule through the heuristic optimization method.

The model is modified by adding the airflow network object into the model to carry out the natural ventilation calculation. By adding a crack into each zone's interior wall and opening a window under a ventilation schedule, a simple natural ventilation is carried out in the benchmark building.

Figure 4:
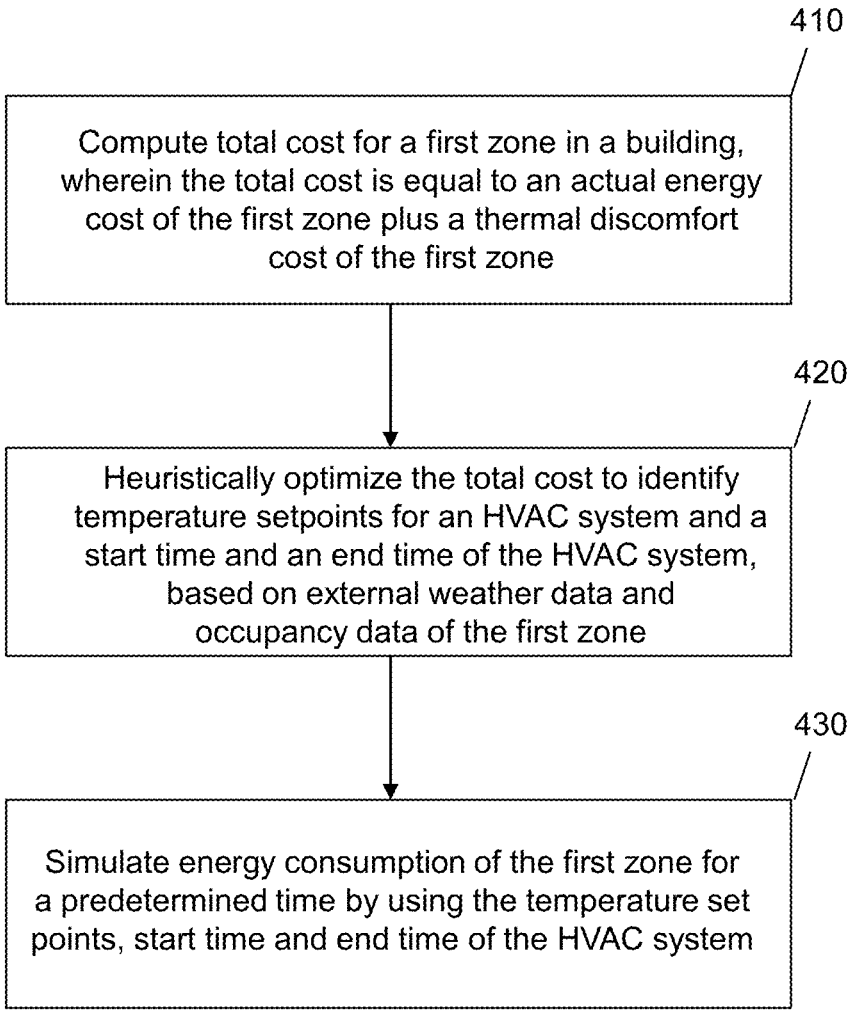
FIG. 4 is a flowchart illustrating a method according to an exemplary embodiment of the present invention.

FIG. 4 is a flowchart illustrating a method according to an exemplary embodiment of the present invention. As shown in FIG. 4, a simulation is first set up (410). In 410, an energy consumption simulation of a first building zone is set up for a predetermined time. The simulation uses temperature set points, a start time and an end time of an HVAC system. It is to be understood that although one zone is being simulated here, multiple zones may be simulated in this step. Further, the one zone may include one or more rooms.

Next, the simulation is run and the total cost is computed (420). In 420, the total cost for the first zone is computed. The total cost is equal to an actual energy cost of the first zone plus a thermal discomfort cost of the first zone. In step 430, steps 410 and 420 are caused to be repeated multiple times for different temperature set points, start times and end times. After multiple runs, the optimal total cost is identified to find the best temperature set point, start time and end time of the HVAC system.

The optimal total cost is determined on the basis of external weather data and occupancy data of the first zone. For example, the external weather data and occupancy data may be predictive data and are set in step 410 as the simulation environment. The optimized results (e.g., temperature setpoints, start and duration of natural ventilation) match with one set of weather data and occupancy data. In other words, the optimized results are optimal in the context of this weather and this occupancy data. Once determined, the optimized temperature set points, start time and end time of the HVAC system may be applied to a real building corresponding to the simulated building (440).

A comparison of results obtained by simulating exemplary embodiments of the present invention in different environments will now be provided.

Simulations were run on days of the year that have the maximum daily day and night temperature difference at 16 different locations. For hot areas such as Miami and Houston, this day usually occurs in the winter while for cold areas such as Chicago this day usually occurs during summer. The table in FIG. 5 shows the details of the optimized HVAC ventilation start time and duration in 16 areas.

In the following, detailed simulation results of three locations (e.g., Chicago, Baltimore and Atlanta) are illustrated to show an energy consumption difference between an optimized hybrid ventilation building and a conventional air conditioned building.

Figure 6:
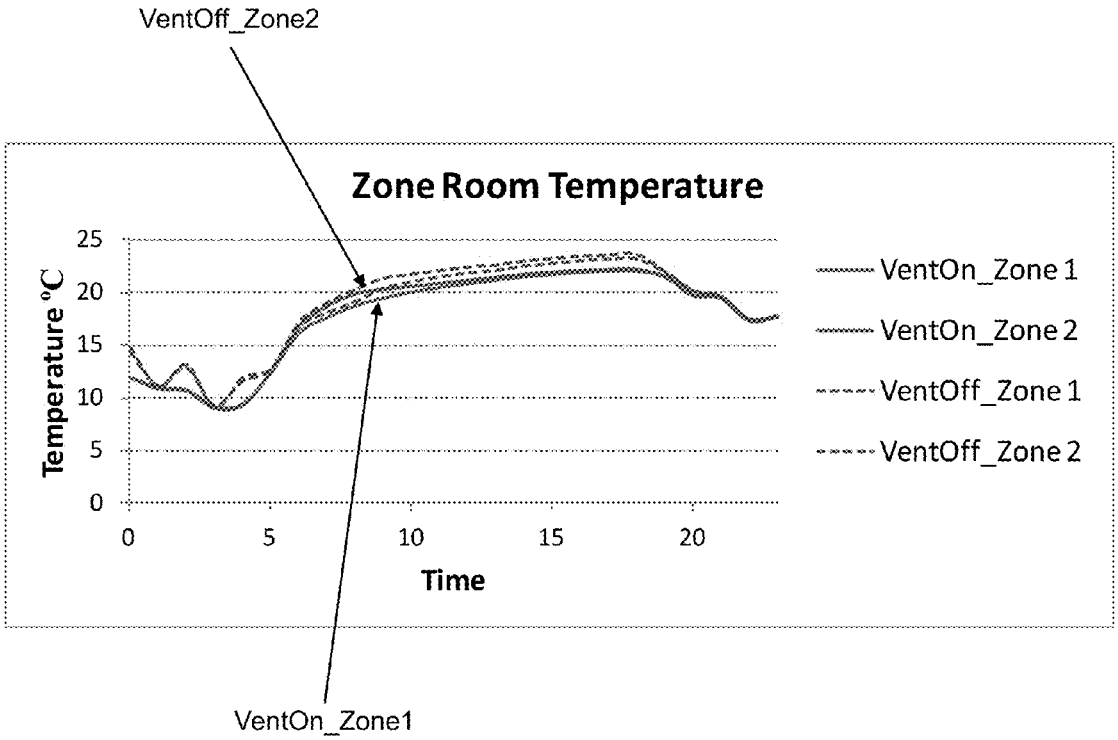
FIG. 6 is a simulation graph illustrating zone 1 and zone 2 temperatures with and without natural ventilation in a first environment, according to an exemplary embodiment of the present invention.
Figure 7:
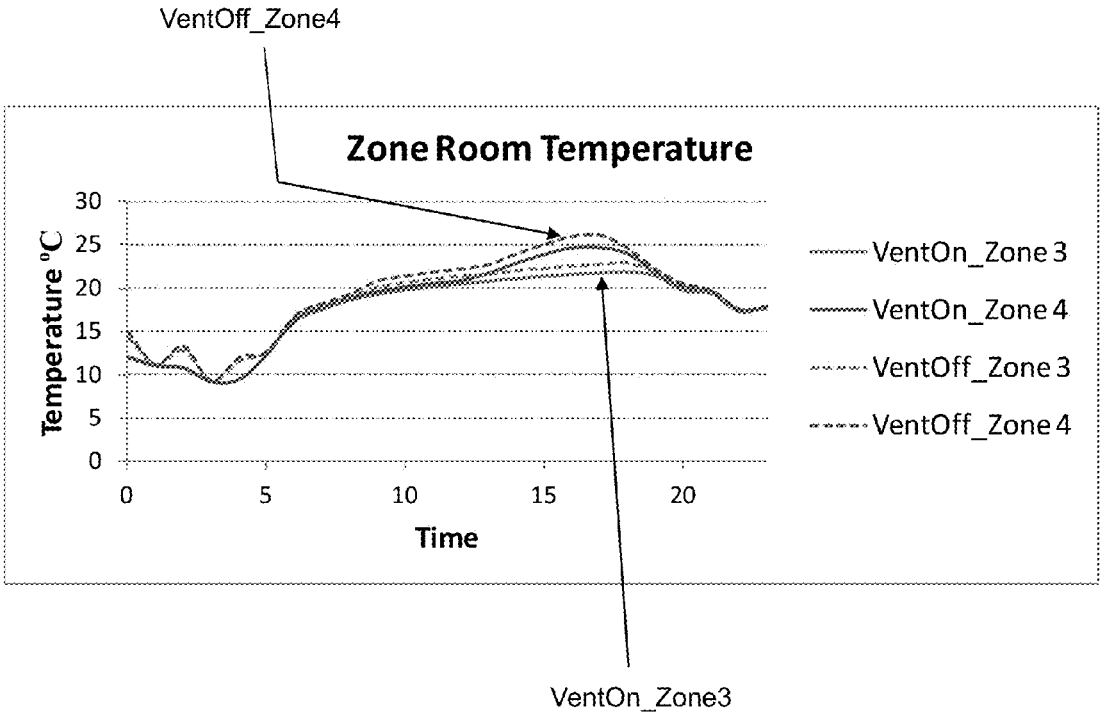
FIG. 7 is a simulation graph illustrating zone 3 and zone 4 temperatures with and without natural ventilation in the first environment, according to an exemplary embodiment of the present invention.
Figure 8:
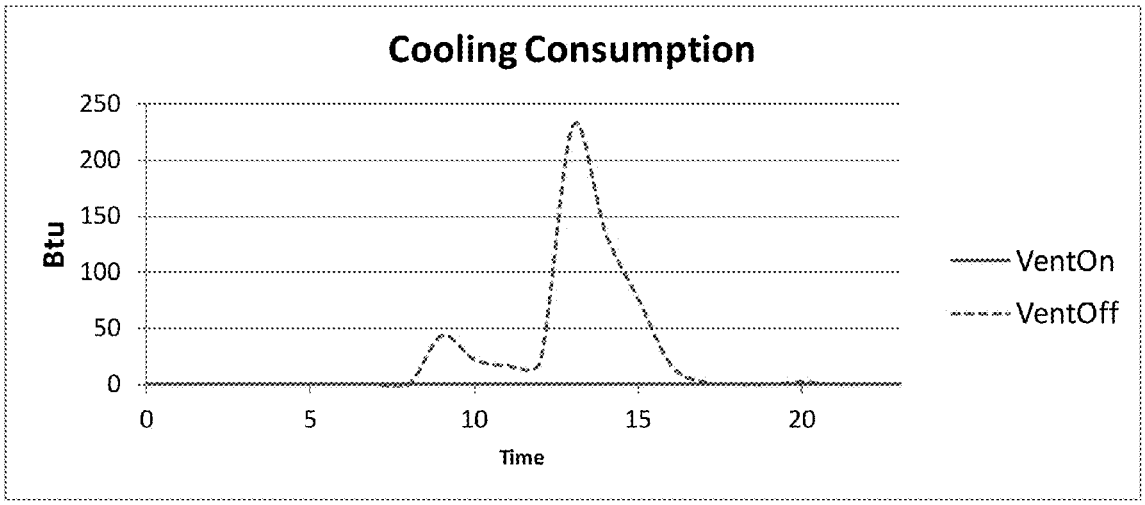
FIG. 8 is a simulation graph illustrating cooling consumption with and without natural ventilation in the first environment, according to an exemplary embodiment of the present invention.
Figure 9:
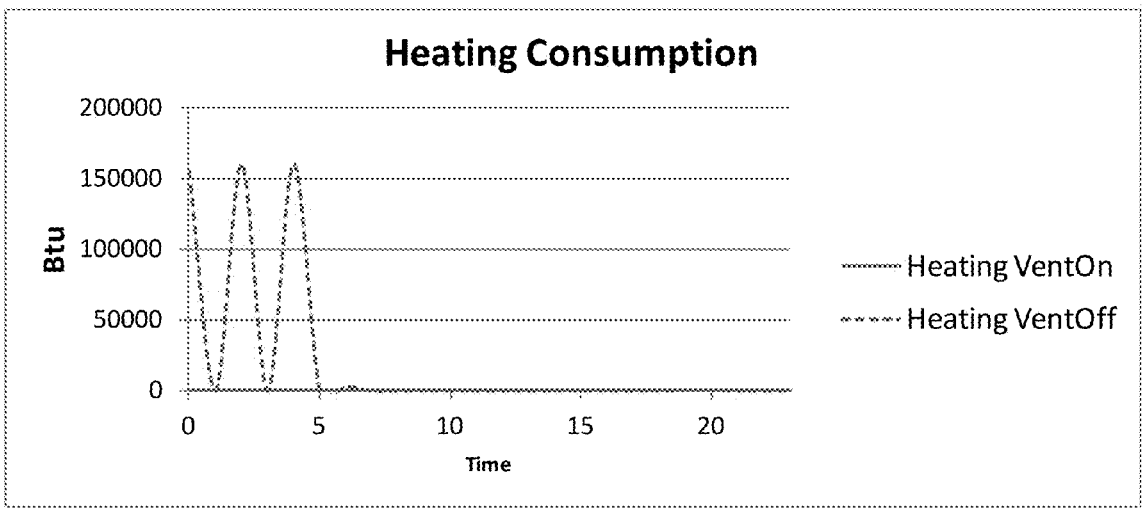
FIG. 9 is a simulation graph illustrating heating consumption with and without natural ventilation in the first environment, according to an exemplary embodiment of the present invention.

Chicago has good weather conditions to carry out natural ventilation during some times of the year. The day selected here is May 27 which requires no air conditioning. The zone room temperature is shown in FIGS. 6 and 7. From FIGS. 6 and 7, we can see that the two situations have a small difference. Since people can tolerate higher temperatures when a building adopts natural ventilation, the calculation shows that the total cost including energy cost and discomfort cost is minimized by turning off HVAC systems. Cooling and heating energy consumption are shown in FIGS. 8 and 9, respectively.

In Chicago, on certain days, cooling is not needed during daytime. The simulation demonstrates that cooling by turning on natural ventilation in summer has substantial energy savings compared to cooling with a conventional air conditioning system.

Figure 10:
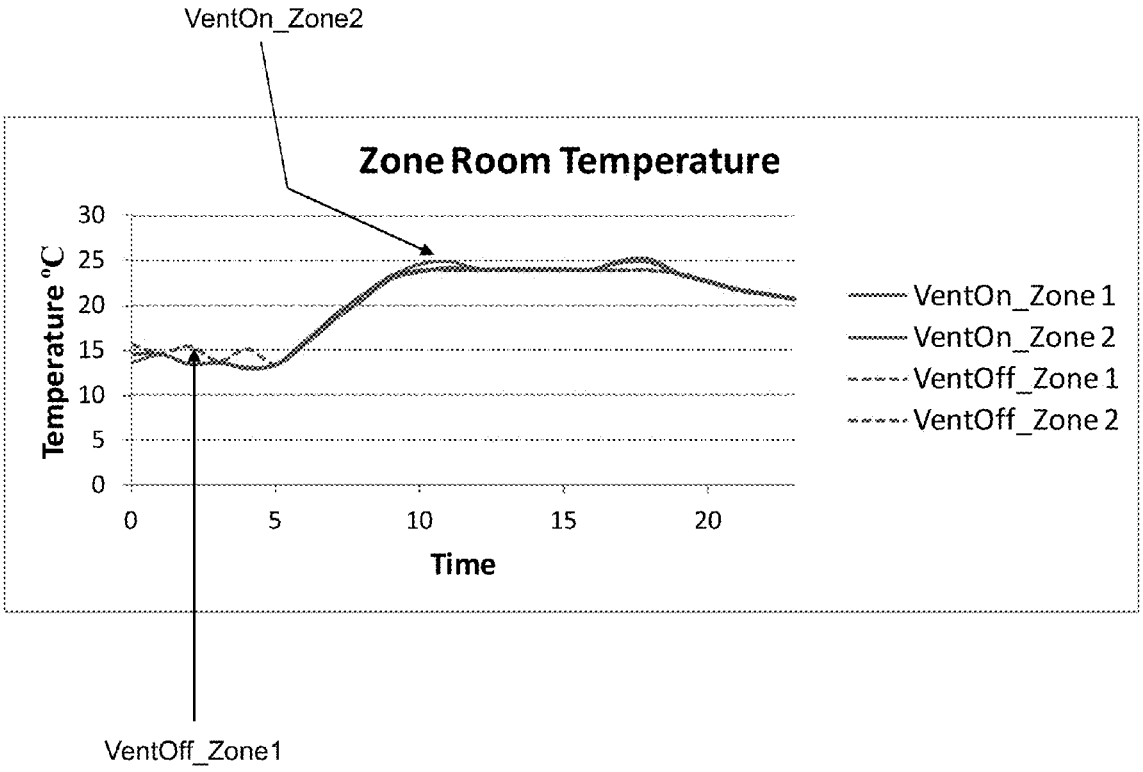
FIG. 10 is a simulation graph illustrating zone 1 and zone 2 temperatures with and without natural ventilation in a second environment, according to an exemplary embodiment of the present invention.
Figure 11:
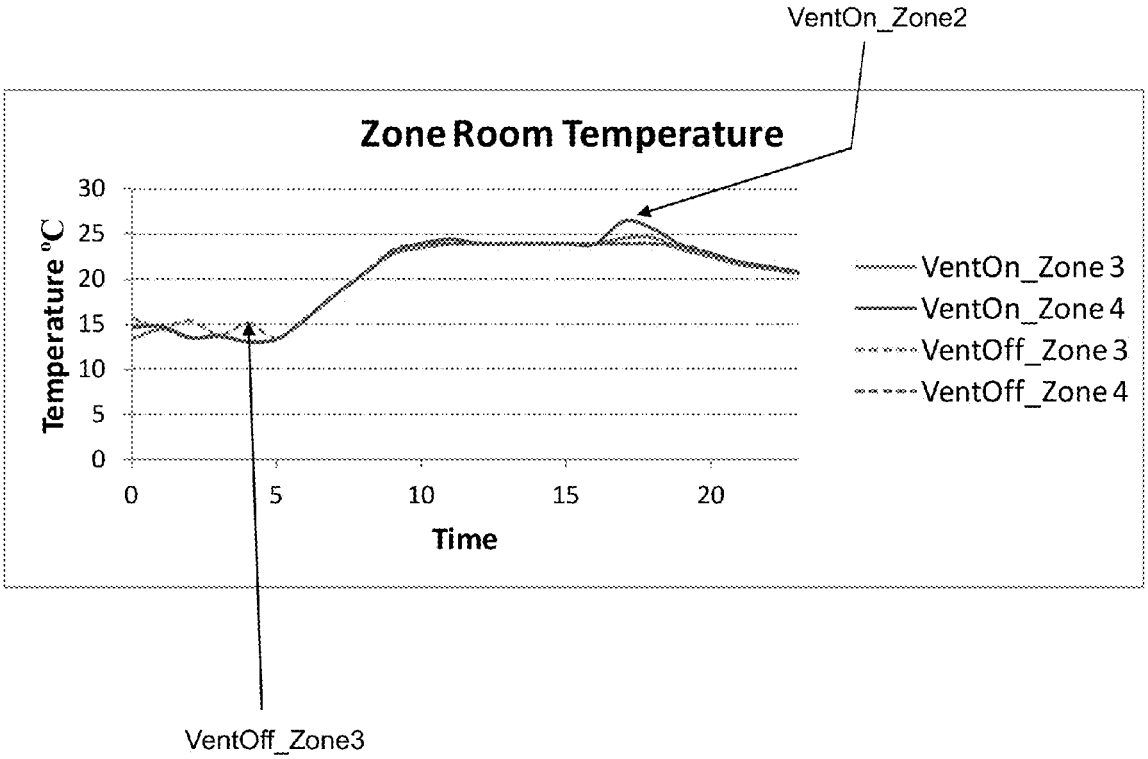
FIG. 11 is a simulation graph illustrating zone 3 and zone 4 temperatures with and without natural ventilation in the second environment, according to an exemplary embodiment of the present invention.
Figure 12:
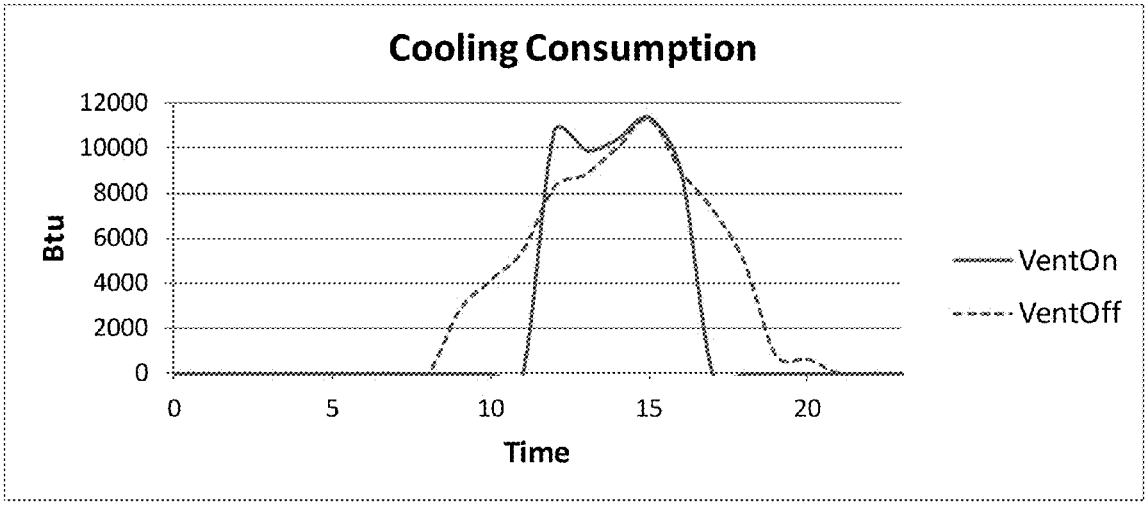
FIG. 12 is a simulation graph illustrating cooling consumption with and without natural ventilation in the second environment, according to an exemplary embodiment of the present invention.
Figure 13:
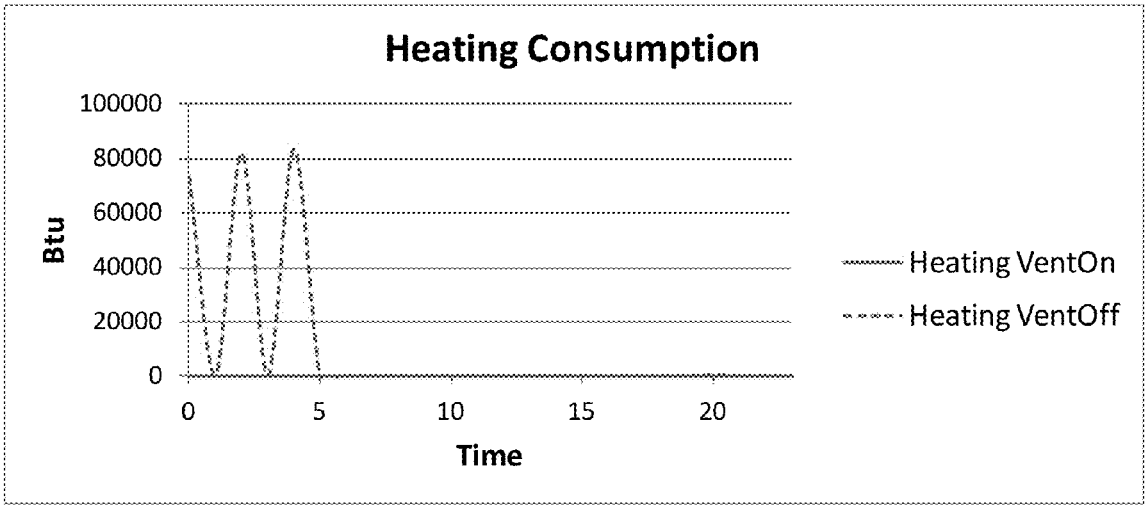
FIG. 13 is a simulation graph illustrating heating consumption with and without natural ventilation in the second environment, according to an exemplary embodiment of the present invention.

Baltimore is also suitable to carry out natural ventilation during some times of the year. The day selected here is May 17. The zone room temperature is shown in FIGS. 10 and 11. From FIGS. 10 and 11, it can be seen that the two situations have a very small difference. Since people can tolerate higher temperatures when a building adopts natural ventilation, the calculation shows that the total cost including energy cost and discomfort cost is minimized by turning off HVAC for natural ventilation. Cooling and heating energy consumption are shown in FIGS. 12 and 13, respectively.

In Baltimore, the cooling energy savings on the selected day in the simulation was 30% compared with no natural ventilation. Thus, optimized hybrid ventilation showed substantial energy saving potential in this area.

Figure 14:
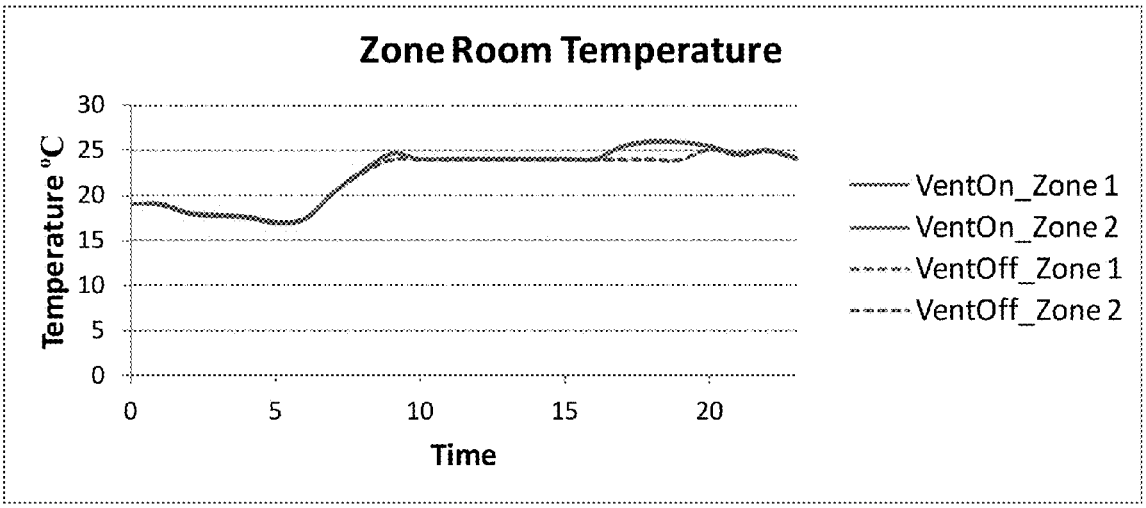
FIG. 14 is a simulation graph illustrating zone 1 and zone 2 temperature with and without natural ventilation in a third environment, according to an exemplary embodiment of the present invention.
Figure 15:
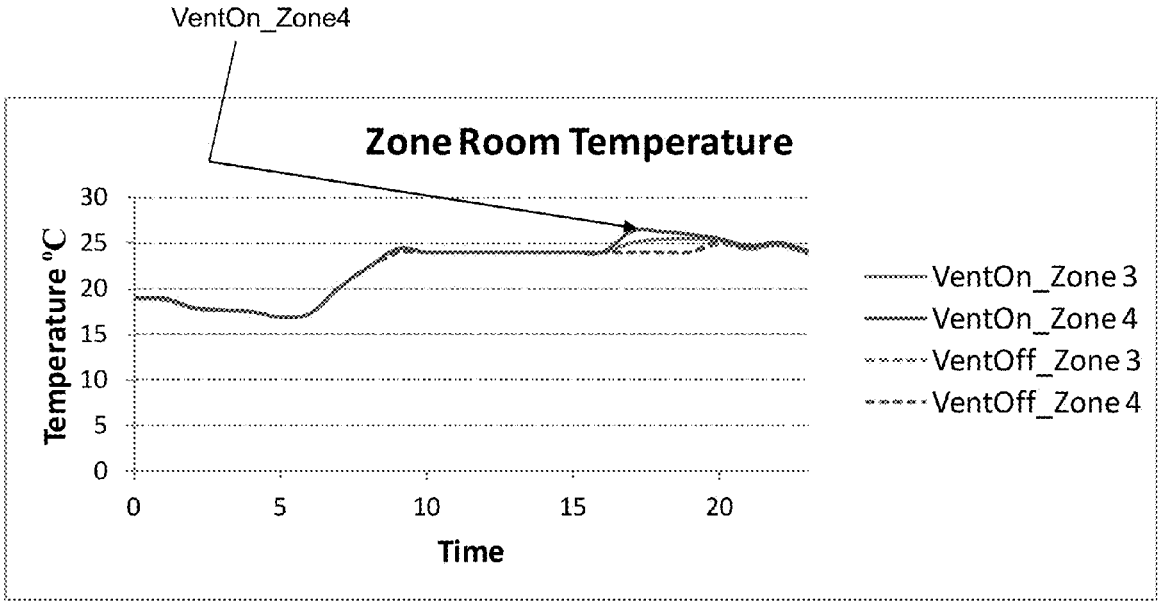
FIG. 15 is a simulation graph illustrating zone 3 and zone 4 temperatures with and without natural ventilation in the third environment, according to an exemplary embodiment of the present invention.
Figure 16:
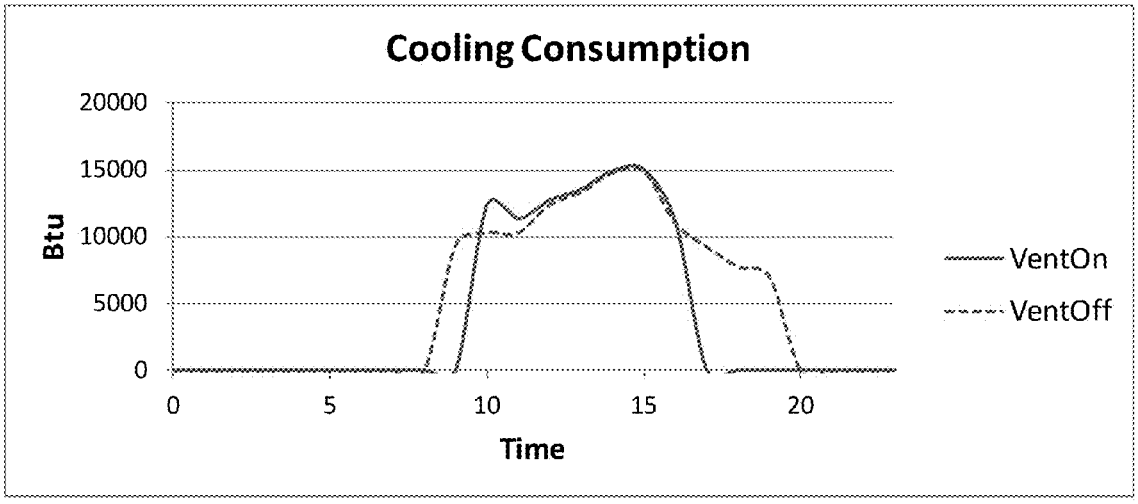
FIG. 16 is a simulation graph illustrating cooling consumption with and without natural ventilation in the third environment, according to an exemplary embodiment of the present invention.
Figure 17:
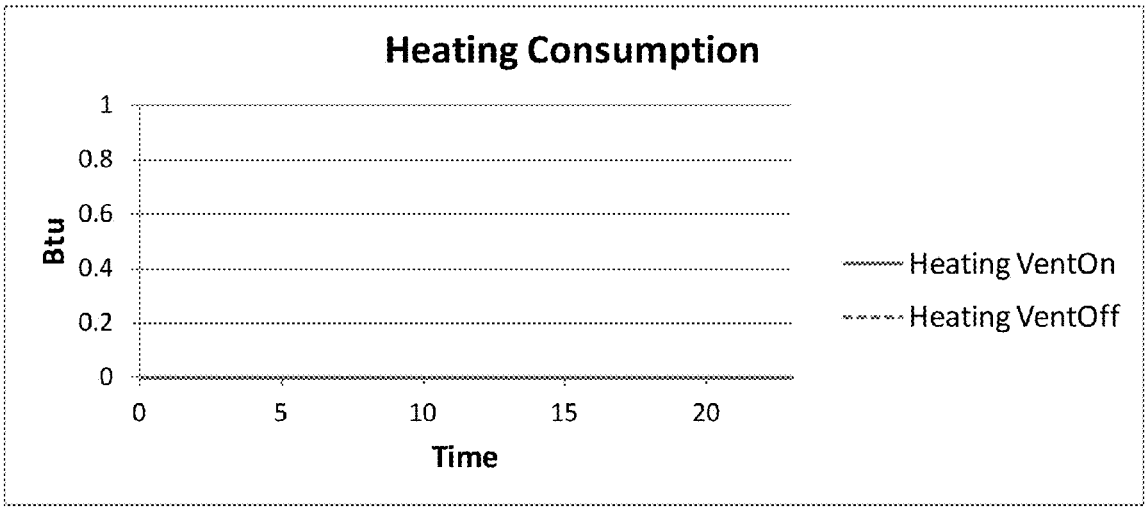
FIG. 17 is a simulation graph illustrating heating consumption with and without natural ventilation in the third environment, according to an exemplary embodiment of the present invention.

Atlanta is also suitable to carry out natural ventilation during some times of the year. The day selected here is September 11. The zone room temperature is shown in FIGS. 14 and 15. From FIGS. 14 and 15, it can be seen that the two situations have a very small difference. Since people can tolerate higher temperatures when a building adopts natural ventilation, the calculation shows that the total cost including energy cost and discomfort cost is minimized by turning off HVAC during the natural ventilation period. Cooling and heating energy consumption are shown in FIGS. 16 and 17, respectively.

In Atlanta, the cooling energy savings on the selected day in the simulation was 24%. Thus, optimized hybrid ventilation also shows substantial energy saving potential in this area.

Figure 18:
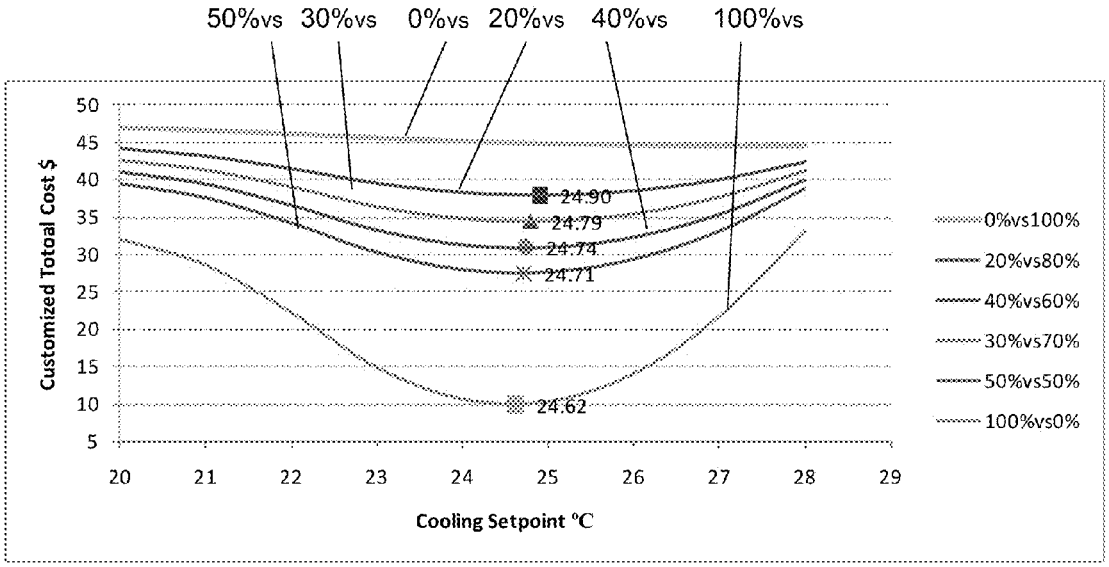
FIG. 18 is a simulation graph used to heuristically optimize the best cooling set point, according to an exemplary embodiment of the present invention.

FIG. 18 shows using the optimization methodology of an exemplary embodiment of the present invention to find the optimal cooling set-point considering different weighting facts in the total cost formula:

$$\text{Total cost}=a\%\ \text{Discomfort cost}+(1-a\%)\text{Energy cost} \quad (6)$$

Figure 19:
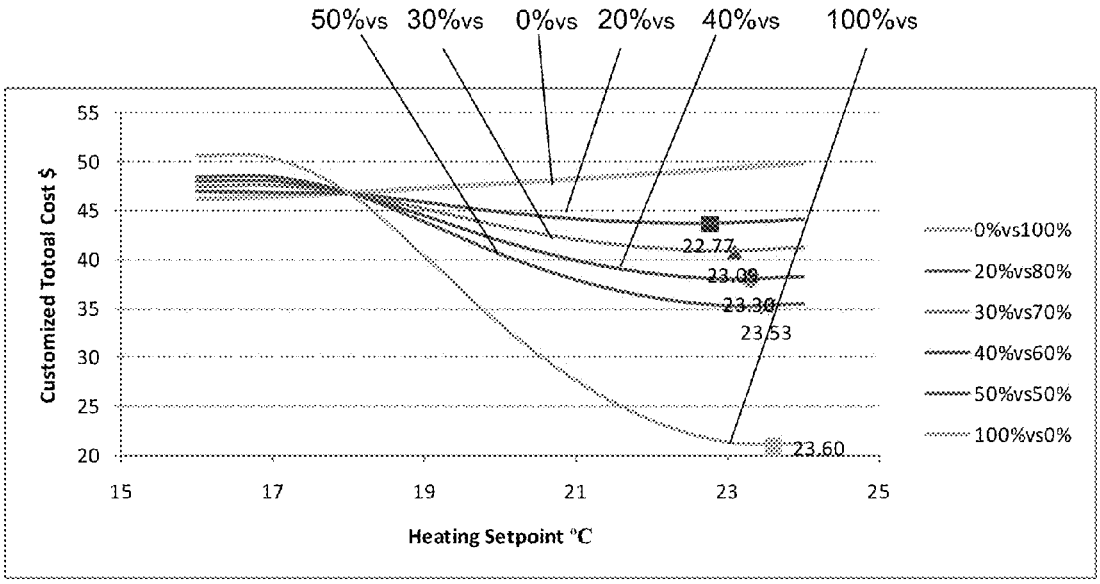
FIG. 19 is a simulation graph used to heuristically optimize the best heating set point, according to an exemplary embodiment of the present invention.

FIG. 19 shows using the optimization methodology of an exemplary embodiment of the present invention to find the optimal heating set-point considering different weighting facts in the total cost formula (6).

A simulation-based total cost optimization for buildings with hybrid ventilation according to an exemplary embodiment of the present invention has been described. From the simulation results illustrated above, optimized hybrid ventilation achieves substantial building energy cost savings while providing good indoor air quality and acceptable thermal comfort. However, a restriction is that natural ventilation is dependent on weather conditions. Besides that, natural ventilation can only be carried out in building exterior zones with operable windows. In this case, the savings might not be so great in buildings which have large interior zones. Some contributions of this invention are summarized as follows.

1. Hybrid ventilation is built on the benchmark building model which ASHRAE designed as a standard for 16 different climate areas.

2. The modified model describes exterior zones' potential to be naturally ventilated. Not all buildings are designed for hybrid ventilation. The modified model could help in exploring an existing building's potential to be naturally ventilated by opening windows during certain times of the year.

3. The model can give a quick and easy estimation on the potential energy savings of small office type buildings. The same methodology can be applied for other building types to get an estimation of their energy savings potential in the same or different climate areas.

4. The concept of thermal discomfort cost is introduced and the total comfort cost is optimized based on the simulation strategy. The control strategy based on this optimization considers both the thermal comfort and energy consumption.

5. A heuristic optimization method in implemented in our analysis.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article or manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 20:
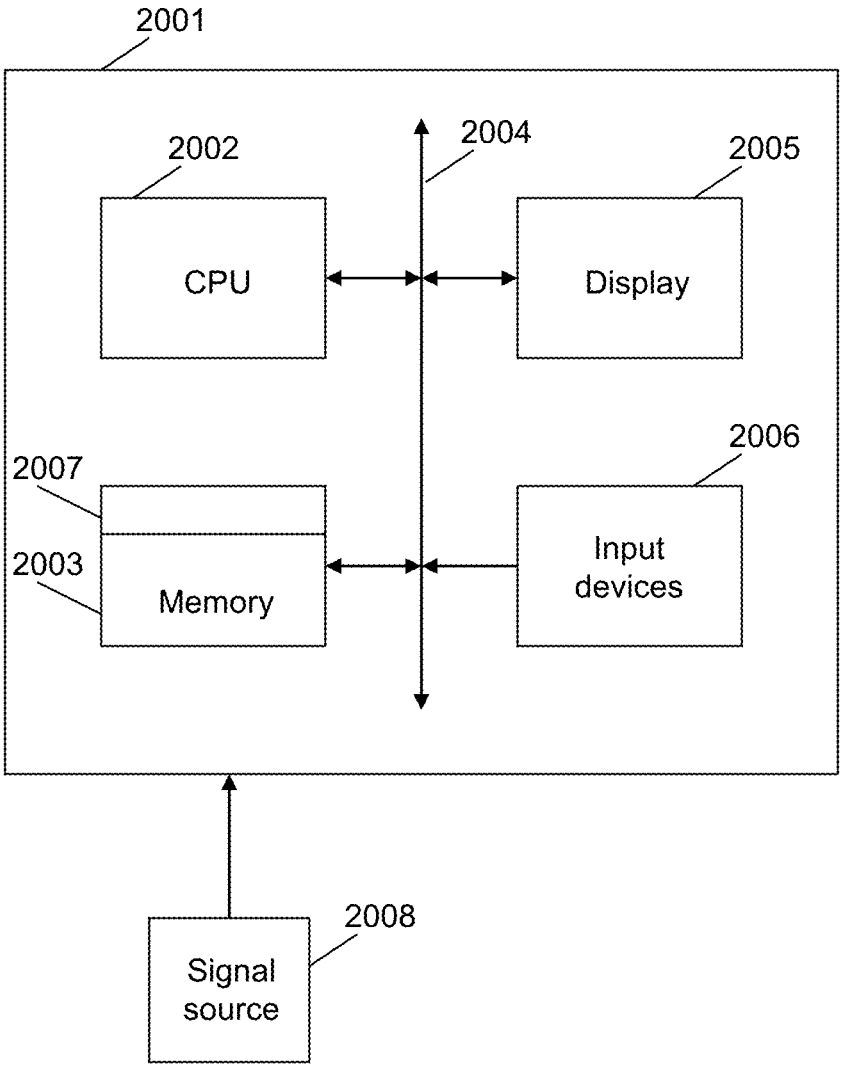
FIG. 20 illustrates a computer system in which an exemplary embodiment of the present invention may be implemented.

Referring now to FIG. 20, according to an exemplary embodiment of the present invention, a computer system 2001 can comprise, inter alia, a central processing unit (CPU) 2002, a memory 2003 and an input/output (I/O) interface 2004. The computer system 2001 is generally coupled through the I/O interface 2004 to a display 2005 and various input devices 2006 such as a mouse and keyboard. The support circuits can include circuits such as cache, power supplies, clock circuits, and a communications bus. The memory 2003 can include RAM, ROM, disk drive, tape drive, etc., or a combination thereof. Exemplary embodiments of present invention may be implemented as a routine 2007 stored in memory 2003 (e.g., a non-transitory computer-readable storage medium) and executed by the CPU 2002 to process the signal from a signal source 2008. As such, the computer system 2001 is a general-purpose computer system that becomes a specific purpose computer system when executing the routine 2007 of the present invention.

The computer system 2001 also includes an operating system and micro-instruction code. The various processes and functions described herein may be either part of the micro-instruction code or part of the application program (or a combination thereof) which is executed via the operating system. In addition, various other peripheral devices may be connected to the computer system 2001 such as an additional data storage device and a printing device.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described to best explain the principles of the invention and the practical application, and to enable others of ordinary skill in the art to understand the invention for various embodiments with various modifications as are suited to the particular use contemplated.

What is claimed is:

1. A method, comprising:

simulating energy consumption of the first zone for a predetermined time by using temperature setpoints, a start time and an end time of the mechanical heating/cooling system associated with the computed total cost;

heuristically optimizing a total cost associated with a first zone in a building to identify optimal temperature setpoints for a mechanical heating/cooling system and a start time and an end time of the mechanical heating/cooling system based on external weather data and occupancy data of the first zone, wherein the total cost is based on an actual energy cost of the first zone plus a thermal discomfort cost of the first zone;

wherein the actual energy cost of the first zone is equal to electricity cost of the first zone for a predetermined time plus gas/oil cost of the first zone for the predetermined time;

wherein the thermal discomfort cost is a cost value lost due to discomfort of at least one person in the first zone as represented by the following equation:

$$\text{Discomfort cost} = (1-\text{RP})*pr_{max}*\text{people},$$

wherein RP is relative performance of a person compared to maximum performance $pr_{max}$ as a function of a thermal sensation value, $pr_{max}$ is a maximum performance rate which indicates a maximum monetary value generated by the person at their full thermal comfort, a high RP indicates a high comfort level of the person and a low RP indicates a low comfort level of the person; and wherein the thermal sensation value is determined by applying a comfort model to an operative temperature value for the first zone.

2. The method of claim 1, wherein the first zone includes at least one room.

3. The method of claim 1, wherein the heuristic optimization includes repeating steps of computing a total cost and simulating energy consumption using different temperature setpoints, start times and end times of the mechanical heating/cooling system.

4. The method of claim 1, wherein the thermal discomfort cost of the first zone is a cost value lost due to discomfort of at least one person in the first zone.

5. The method of claim 1, wherein the temperature setpoints include a temperature of the first zone for a minimum cooling cost or a temperature of the first zone for a minimum heating cost.

6. The method of claim 1, wherein windows in the first zone are closed at the start time of the mechanical heating/cooling system and the windows in first zone are opened at the end time of the mechanical heating/cooling system.

7. A system, comprising:

a memory device for storing a program;

a processor in communication with the memory device, the processor operative with the program to:

simulate energy consumption of the first zone for a predetermined time by using temperature setpoints, a start time and an end time of the mechanical heating/cooling system associated with the computed cost;

heuristically optimize a total cost associated with a first zone in a building to identify temperature optimal setpoints for a mechanical heating/cooling system and a start time and an end time of the mechanical heating/cooling system based on external weather data and occupancy data of the first zone, wherein the total cost is based on an actual energy cost of the first zone plus a thermal discomfort cost of the first zone;

wherein the actual energy cost of the first zone is equal to electricity cost of the first zone for a predetermined time plus gas/oil cost of the first zone for the predetermined time;

wherein the thermal discomfort cost is a monetary cost value lost due to discomfort of at least one person in the first zone as represented by the following equation:

$$\text{Discomfort cost} = (1-\text{RP})*pr_{max}*\text{people},$$

wherein RP is relative performance of a person compared to maximum performance $pr_{max}$ as a function of a thermal sensation voting value, $pr_{max}$ is a maximum performance rate which indicates a maximum monetary value generated by the person at their full thermal comfort, a high RP indicates a high comfort level of the person and a low RP indicates a low comfort level of the person; and wherein the thermal sensation value is determined by applying a comfort model to an operative temperature value for the first zone.

8. The system of claim 7, wherein the first zone includes at least one room.

9. The system of claim 7, wherein the temperature set points include a temperature of the first zone for a minimum cooling cost or a temperature of the first zone for a minimum heating cost.

10. The system of claim 7, wherein windows in the first zone are closed at the start time of the mechanical heating/cooling system and the windows in first zone are opened at the end time of the mechanical heating/cooling system.

11. A computer program product, comprising:

a non-transitory computer readable storage medium having computer readable program code embodied therewith, the computer readable program code configured to perform the steps of:

simulating energy consumption of the first zone for a predetermined time by using temperature setpoints, a start time and an end time of the mechanical heating/cooling system associated with the computed cost, prior to the step of heuristically optimizing;

heuristically optimizing a total cost associated with a first zone in a building to identify optimal temperature setpoints for a mechanical heating/cooling system and a start time and an end time of the mechanical heating/cooling system, based on external weather data and occupancy data of the first zone, wherein the total cost is based on an actual energy cost of the first zone plus a thermal discomfort cost of the first zone;

wherein the actual energy cost of the first zone is equal to electricity cost of the first zone for a predetermined time plus gas/oil cost of the first zone for the predetermined time;

wherein the thermal discomfort cost is a monetary cost value lost due to discomfort of at least one person in the first zone as represented by the following equation:

$$\text{Discomfort cost} = (1-\text{RP}) * pr_{max} * \text{people},$$

wherein RP is relative performance of a person compared to maximum performance $pr_{max}$ as a function of a thermal sensation voting value, $pr_{max}$ is a maximum performance rate which indicates a maximum monetary value generated by the person at their full thermal comfort, a high RP indicates a high comfort level of the person and a low RP indicates a low comfort level of the person; and wherein the thermal sensation value is determined by applying a comfort model to an operative temperature value for the first zone.

12. The computer program product of claim 11, wherein the first zone includes at least one room.

13. The computer program product of claim 11, wherein the temperature setpoints include a temperature of the first zone for a minimum cooling cost or a temperature of the first zone for a minimum heating cost.

14. The computer program product of claim 11, wherein windows in the first zone are closed at the start time of the mechanical heating/cooling system and the windows in first zone are opened at the end time of the mechanical heating/cooling system.

* * * * *